US008566972B2

(12) United States Patent
Vogtner et al.

(10) Patent No.: US 8,566,972 B2
(45) Date of Patent: Oct. 29, 2013

(54) LIQUID AROMA INJECTOR

(75) Inventors: Zachary Thomas Vogtner, Atlanta, GA (US); Nathan Zahora, Peachtree City, GA (US)

(73) Assignee: Custom Molded Products, Inc., Newnan, GA (US)

( * ) Notice: Subject to any disclaimer, the term of this patent is extended or adjusted under 35 U.S.C. 154(b) by 529 days.

(21) Appl. No.: 12/857,073

(22) Filed: Aug. 16, 2010

(65) Prior Publication Data

US 2012/0036626 A1 Feb. 16, 2012

(51) Int. Cl.
*A47K 3/00* (2006.01)

(52) U.S. Cl.
USPC ..... 4/559; 4/538; 4/628; 222/372

(58) Field of Classification Search
USPC ..... 4/538, 628, 559, 541.1
See application file for complete search history.

(56) References Cited

U.S. PATENT DOCUMENTS

| | | | | |
|---|---|---|---|---|
| 1,941,751 | A * | 1/1934 | Lupo | 222/484 |
| 4,512,501 | A * | 4/1985 | Foster | 222/153.13 |
| 6,149,036 | A * | 11/2000 | Serio | 222/321.9 |
| 7,258,783 | B2 * | 8/2007 | Harbol | 210/96.1 |
| 7,818,826 | B2 * | 10/2010 | Schmidt et al. | 4/541.6 |
| 2005/0217016 | A1 * | 10/2005 | Ciechanowski et al. | 4/559 |

* cited by examiner

*Primary Examiner* — Gregory Huson
*Assistant Examiner* — Janie Christiansen
(74) *Attorney, Agent, or Firm* — Laurence P. Colton; Smith Risley Tempel Santos LLC

(57) ABSTRACT

A liquid aroma injector for a spa having a reservoir comprising an upper chamber, a lower chamber, and a subchamber, a plunger assembly comprising a plunger button, a shaft, and an annular flanged gasket. The shaft extends through said upper and lower chamber of the reservoir. The liquid aroma injector further comprises a hose through which liquid aroma travels to the liquid aroma diffuser that releases liquid aroma into the water of a spa.

14 Claims, 8 Drawing Sheets

14
14a
82
12
50
80
82
56
58
24
28
28a
28b
16
18
18a
18b
18c
26a
34
14
58
56
62
60
60

LIQUID AROMA INJECTOR

BACKGROUND OF THE INVENTION

1. Field of the Invention

The present invention relates generally to a liquid aroma injector, and relates more specifically to a liquid aroma injector that controls the flow of scented liquid allowed to enter a spa or the like.

2. Related Art

Hydrotherapy is a non-invasive form of treatment where a patient can be treated for many conditions like muscle spasms, wounds, burns, and sprains by manipulating the temperature and circulation of and pressure created by streams of water in an enclosure. Hydrotherapy is also useful for massaging, relaxing, and reviving a user.

Conventional spas, hot tubs, whirlpool baths, swimming pools, showers and the like, including hydrotherapy equipment, all of which are referred to herein collectively as spas, can be used in hydrotherapy. Spas often comprise means to generate air bubbles to entrain in a water flow or jet to strategically send aerated waters to massage and soothe the body of a user. Spas typically are constructed as a molded shell to form a water containment or fluid enclosure having a foot well or floor and an upstanding sidewall. Molded within the enclosure can be a plurality of therapy stations which may include seats or platforms for reclining. The shell typically is constructed of fiberglass, plastic or a similar material, or a composite of such materials. One or more pumps usually are placed under or proximal to the shell to draw water from the enclosure, recirculate it, and discharge it with air from an air line as an aerated water stream into the enclosure through a plurality of nozzles or water jets of various types. The water jets usually are mounted through the shell in either or both of the floor and sidewall. Typically, water jets mounted through the sidewall are located below the maximum water line of the spa.

The massaging and therapeutic action of a spa usually is provided by water jets that are mounted on or recessed into the walls of the artificial water structure. Several water jets are usually spaced about the perimeter of an artificial water structure. Water jets typically comprise nozzles for forming and adjusting the water flow through the water jets and, in some water jets, the nozzles may be rotated to achieve a desired flow in order to maximize the therapeutic effect. The nozzle can be a swivel type nozzle, which allows the direction of the flow to be adjusted by the user of the artificial water structure to further maximize massaging or therapeutic action, and often is referred to as a directional nozzle. The nozzle also can be immovably attached to the spa sidewall, and groups of such nozzles often are referred to as cluster jets.

Aromatherapy is the use of aromatic and/or medicinal vapors to enhance the feeling of well-being of a user and for other therapeutic effects including healing and relaxation. Often, essential oils and hydrosols (aromas) are extracted from plants and herbs and used to provide the therapeutic aromas used in aromatherapy. These fragrant aromas can be used in either liquid or vapor form.

The aromas can enter the body through the skin or the olfactory system. Aromas can be absorbed through the skin through direct contact, or they can be added to water or another carrier. The aromas also can diffuse through the air and enter the nose of a user. Studies suggest that aromatherapy induces deeper breathing, which assists in oxygenation of the blood and may serve to improve overall cardiovascular health.

Combining the effects of hydrotherapy and aromatherapy would be advantageous for enhanced relaxation and circulatory benefits. Conventional spa aromatherapy systems work by introducing airborne aroma through the air lines, into the aerated water stream of the spa, and then into the water. These systems require an air blower to carry the scent through the plumbing of the spa into the water of the spa, which results in a low concentration and uneven distribution of aroma, causes undesired "mixing" of various scents over time, and requires frequent cleaning of the plumbing due to sticky buildup from the airborne aroma. Other conventional systems include the direct introduction of liquid aroma into the water by, for example, the user pouring the liquid aroma from a bottle or another container directly into the spa water. Because liquid aroma that is poured directly into the spa water is not easily stored in the immediate vicinity of a spa, it is not readily available to users and its dispensing rate is not controlled, which can lead to overwhelming and undesirable concentration of liquid aroma. If too much liquid aroma is poured directly into the water of a spa, the only remedy available to a user is to completely empty the spa, clean the spa, and refill the water so that another lesser amount of liquid aroma can be introduced. This process is expensive and time consuming.

Accordingly, there is a need for a readily available, controlled dispensing system for liquid aroma to be used in conjunction with a spa. It is to this need and others that the present invention is directed.

BRIEF SUMMARY OF THE INVENTION

Briefly, the present invention provides a liquid aroma injector that is well suited for use with spas. The liquid aroma dispensing system comprises a plunger, a reservoir, a hose, and a liquid aroma diffuser. In a preferred embodiment there is provided one or more liquid aroma diffusers that are mounted on or recessed into the walls of a spa within a wall fitting. A reservoir is mounted on, within, or behind the spa shell, preferably on the side of the spa enclosure that does not receive water, in an area above the maximum water line of a filled spa and easily accessible to a bather. Alternatively, the reservoir can be mounted in an area immediately adjacent to a spa and easily accessible to a bather. A plunger button mounted on the reservoir can be depressed by a user to release an amount of a liquid aroma into the water within a spa, thus allowing a user to control the concentration of liquid aroma in the water of the spa. Liquid aroma is injected into a body of water in the spa tub or shell cavity holding the main body of water by depressing and releasing the plunger button, which causes the liquid aroma contained within the reservoir to mix with the water from the spa by traveling through the hose and liquid aroma diffuser. Depression of the plunger button moves an annular flanged gasket connected to the end of a shaft, which in turn connects the gasket to the plunger button. The flanged edges of the annular flanged gasket are flush with the inner walls of the reservoir when the plunger button is in a static position. Thus, the liquid aroma is maintained within the reservoir. When the plunger is depressed, the annular flanged gasket flares slightly and moves along the inner walls of the reservoir and forces liquid aroma contained in the hose into the spa through liquid aroma diffusers mounted on the wall of the spa shell cavity. Release of the plunger after depression deforms and collapses the flanged edges of the annular flanged gasket as it gradually returns to its original, D-shaped or V-shaped static position. Further, suction created by check valves mounted at each end of the hose force liquid aroma from the upper reservoir past the flanged edges of the annular flanged gasket and into the lower reservoir which can then be injected into the water of the spa through the hose and subsequently the liquid aroma diffuser. Because a small amount of liquid aroma is released into the spa with each depression of the plunger button, a bather is able to easily and accurately control the dispense rate of liquid aroma into the water of the spa.

The liquid aroma injector allows for the liquid aroma to be stored in the reservoir so that it is readily available to bathers. The reservoir can be refilled after it is mounted by removing the reservoir cap and filling the reservoir with the desired liquid aroma. The reservoir cap eliminates any need to remove the reservoir or any other part of the liquid aroma dispensing system from the spa in order to refill with liquid aroma. Further, the reservoir cap is accessible by a bather from the outside of the spa, and can have scalloped edges to accommodate ease of removal by a user.

An illustrative location for placement of the reservoir is along an upper exposed surface of the spa shell or spa decking, as in positioning the reservoir within a peripheral upper horizontal ledge section of the spa shell or decking surrounding the cavity that receives the body of water. The positioning of the reservoir can be such that a bather can operate liquid aroma injector plunger button by hand while bathing.

Additionally, the plunger button can be turned to lock the plunger assembly to prevent it from engaging. This provides an element of consumer safety and further prevents the unwanted release of liquid aroma into the water of the spa (e.g., a bather unintentionally engages the plunger while entering the spa, or another potentially triggering activity occurs such as the placement of a spa cover in position on the spa). The locking mechanism thus can provide releasable locking ability so as to preclude an unwanted release of liquid aroma into the water of the spa, and yet can be readily disengaged when the release of liquid aroma is desired.

An illustrative embodiment of the present invention features a hose connecting the reservoir to the liquid aroma diffuser. A check valve mounted in the hose adjacent the liquid aroma diffuser keeps spa water from entering the liquid aroma injector and facilitates a pressure buildup inside of the lower reservoir upon disengagement of the plunger button so that an aliquot amount of liquid aroma is released into the lower chamber and hose for dispensation with the next engagement of the plunger button. An additional check valve mounted in the hose adjacent to the lower chamber of the reservoir further separates the liquid aroma from the water until it is injected by a user, and further facilitates this buildup of pressure within the lower reservoir. The liquid aroma is expelled in a controlled manner from the hose and subsequently the liquid aroma diffuser when the plunger button is engaged. The force created by the engagement of the plunger button coupled with the closed check valves not only prevents spa water from backing up into the hose and the reservoir, but also assists in accurate and consistent volume metering for each injection.

In another illustrative embodiment of the present invention, a liquid aroma diffuser is attached to the hose and is mounted within a recessed hole in the spa shell cavity for receiving water. Preferably, the liquid aroma diffuser has a detachable diffuser face with a plurality of holes, through which liquid aroma from inside the hose can be expelled into the water of the spa. The liquid aroma diffuser also comprises a thread to barb hose nozzle fitting and nozzle nut, onto which the diffuser head can be threaded or snapped. Also preferably, the liquid aroma diffuser is provided with a pattern of the plurality of holes such that the liquid aroma is evenly distributed into the water of the spa when expelled.

A complete understanding of the present invention may be obtained by reference to the accompanying drawings, when considered in conjunction with the subsequent, detailed description of preferred embodiments in which like elements and components bear the same designations and numbering throughout the figures.

DETAILED DESCRIPTION OF PREFERRED EMBODIMENTS

Figure 1:
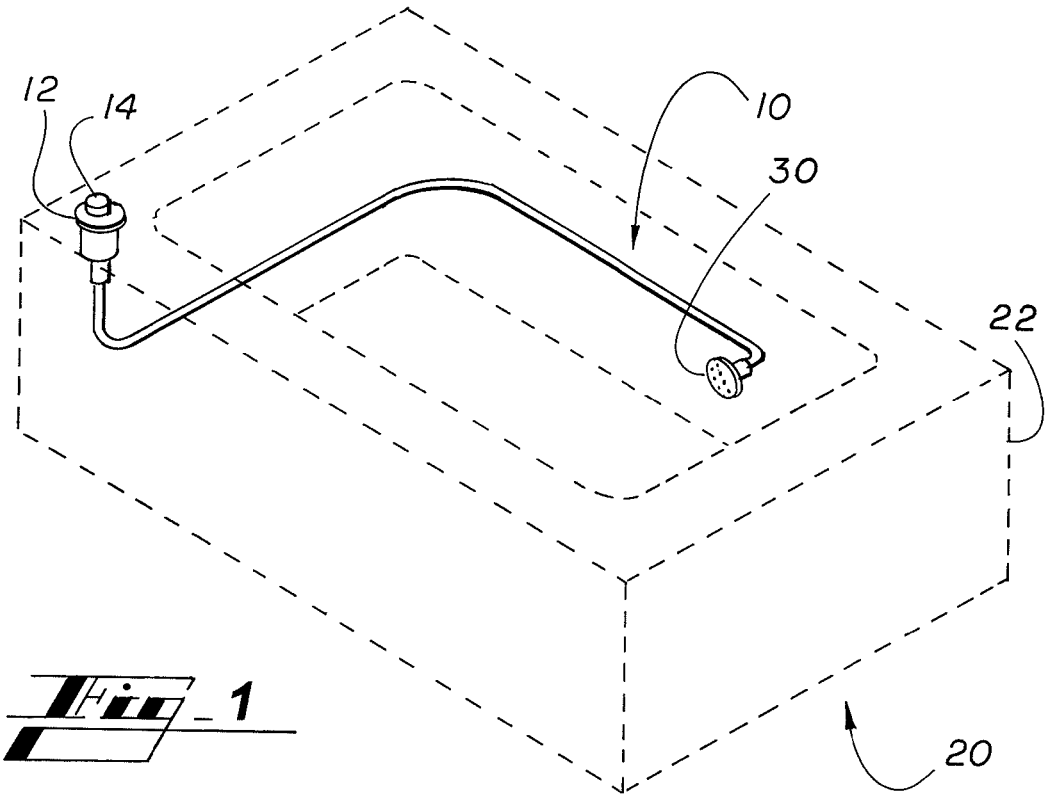
FIG. 1 illustrates an example of a spa having a liquid aroma injector in accordance with the present invention.
Figure 3:
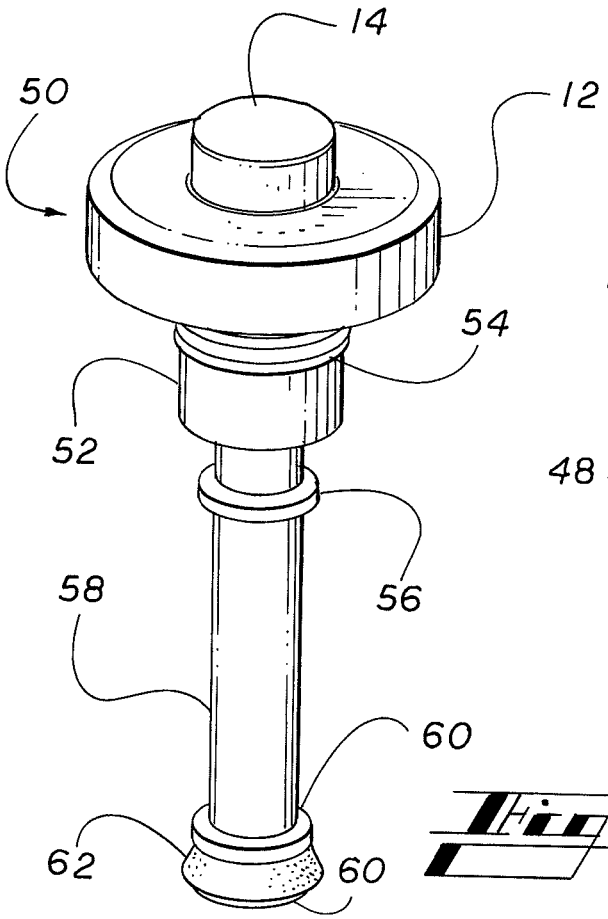
FIG. 3 is a front elevation view of an embodiment of a plunger assembly in accordance with the present invention.
Figure 4:
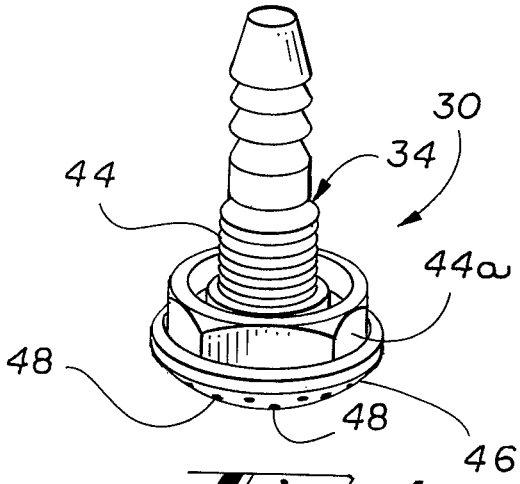
FIG. 4 is a front elevation view of an embodiment of a liquid aroma diffuser in accordance with the present invention.
Figure 2:
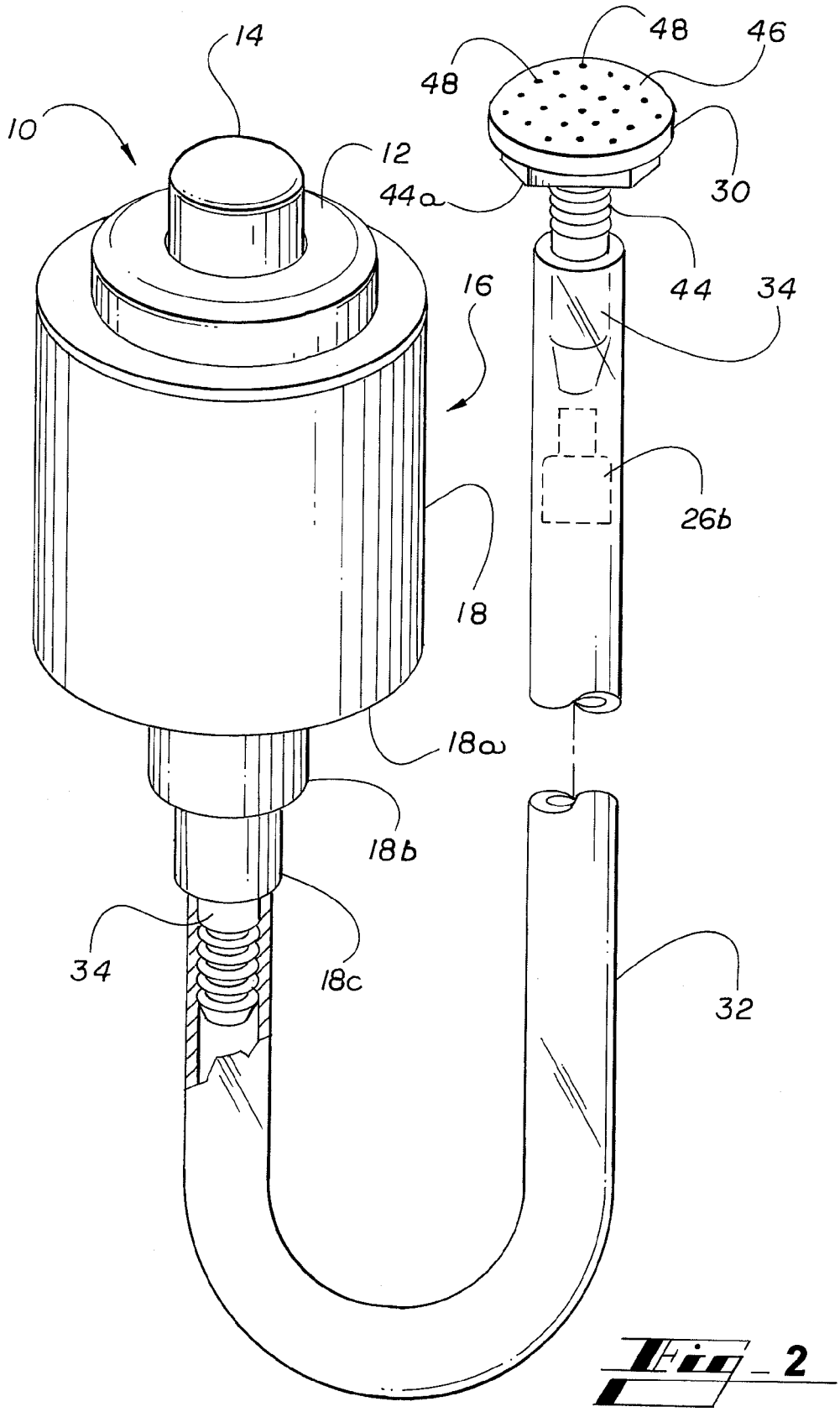
FIG. 2 illustrates a front elevation view of an embodiment of a liquid aroma injector in accordance with the present invention.
Figures 5, 9:
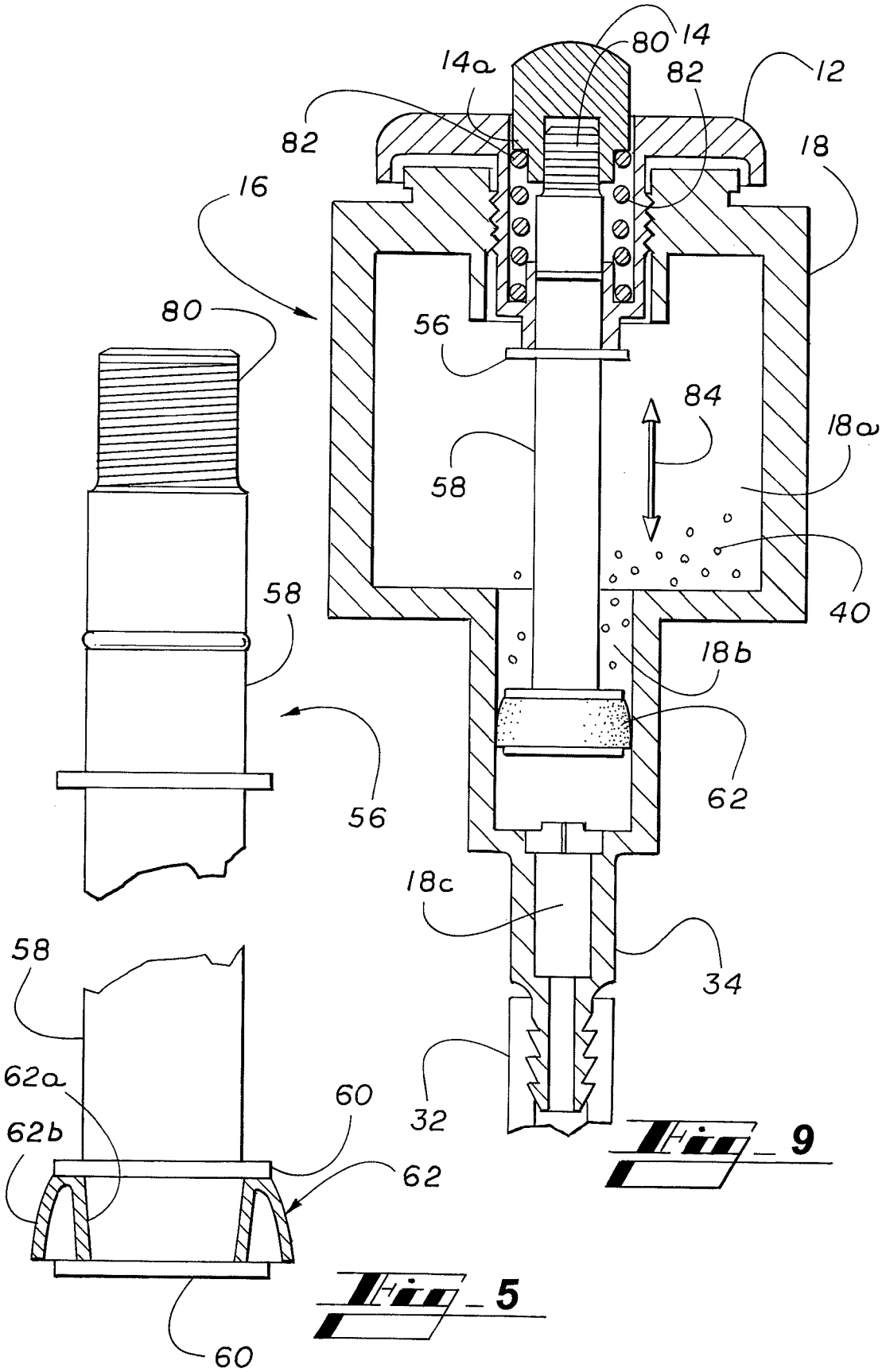
FIG. 5 is an enlarged partial cross-sectional view of an embodiment of the plunger assembly and gasket in accordance with the present invention.
FIG. 9 is a sectional view of the reservoir, showing the component parts in relation to one another and the directions of travel of the shaft.
Figures 6, 7, 8:
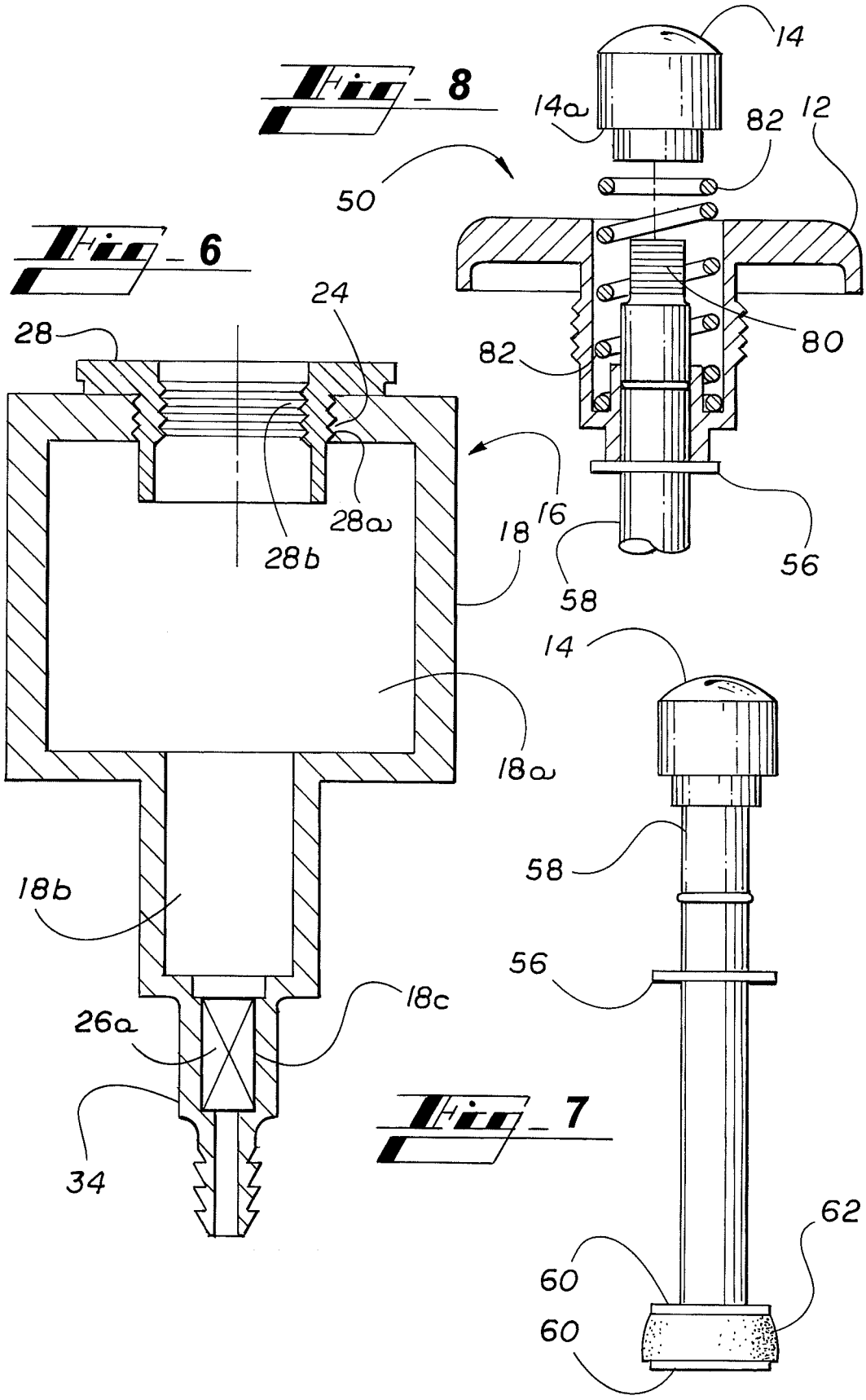
FIG. 6 is a cross-sectional view of an embodiment of the liquid aroma reservoir in accordance with the present invention.
FIG. 7 is a front elevation view of the shaft and plunger button removed from the reservoir cap in accordance with the present invention.
FIG. 8 is a sectional view of the plunger assembly, showing a coiled spring for engagement and disengagement of the plunger button.

FIG. 1 illustrates an example of a spa having a liquid aroma injector in accordance with the present invention. FIGS. 2-4 illustrate views of embodiments of a liquid aroma injector, a plunger assembly, and a liquid aroma diffuser in accordance with the present invention. FIGS. 5-9 are more detailed views of an embodiment of a reservoir and its component parts in accordance with the present invention, with FIG. 5 being an enlarged partial cross-sectional view of a plunger assembly and gasket, and FIG. 6 being a cross-sectional view of a liquid aroma reservoir, showing a wall fitting and check valve. FIG. 7 is a front elevation view of a shaft and plunger button removed from a reservoir cap, FIG. 8 is a sectional view of an exemplary plunger assembly, showing a coiled spring for engagement and disengagement of the plunger button, and FIG. 9 is a sectional view of a reservoir, showing the component parts in relation to one another and the directions of travel of the shaft.

Figure 10:
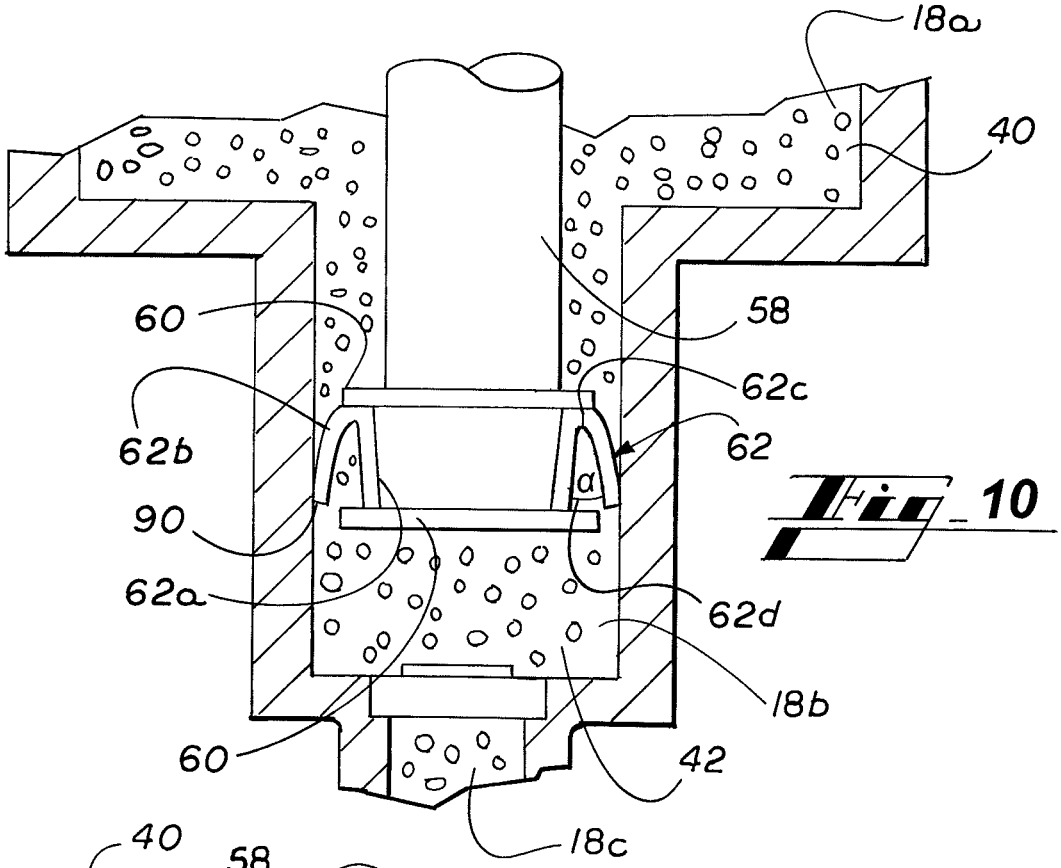
FIG. 10 is a cross sectional view of the shaft and gasket inside of the reservoir of an embodiment of the present invention, and shows the gasket and shaft in a disengaged or returned position.
Figure 11:
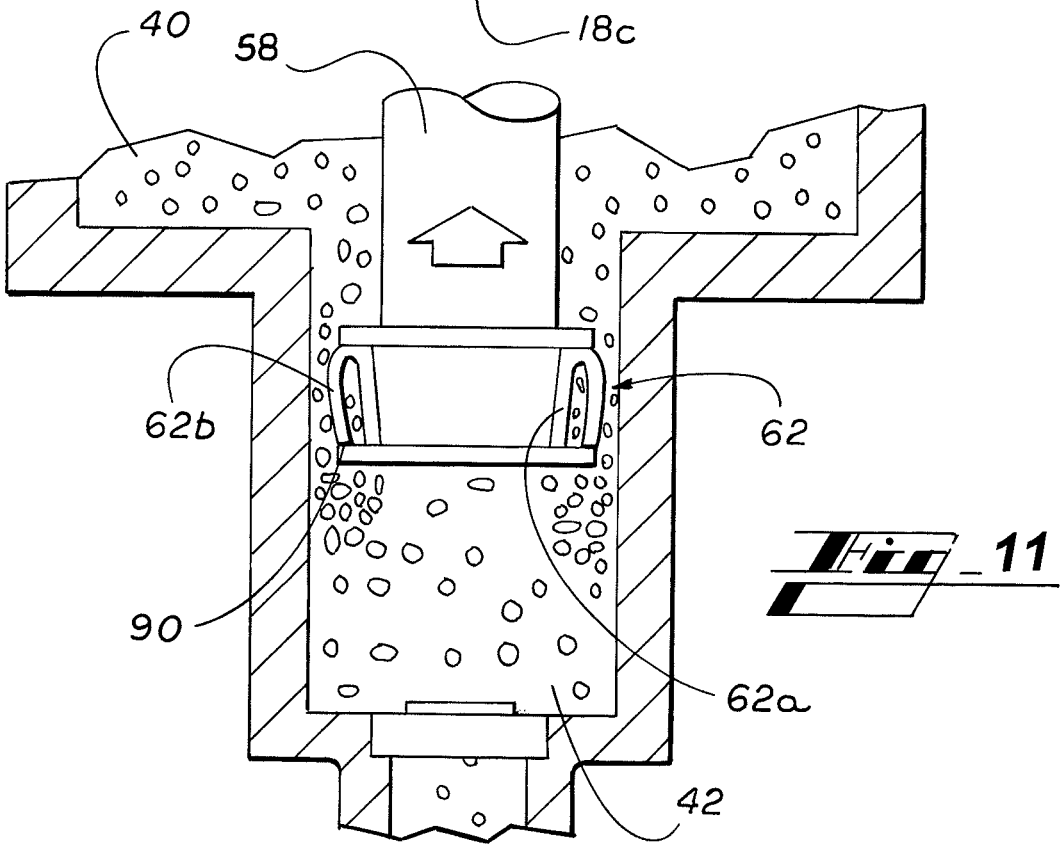
FIG. 11 is a cross sectional view of the shaft and gasket inside of the reservoir of an embodiment of the present invention, showing the gasket and shaft in a returning position.
Figure 12:
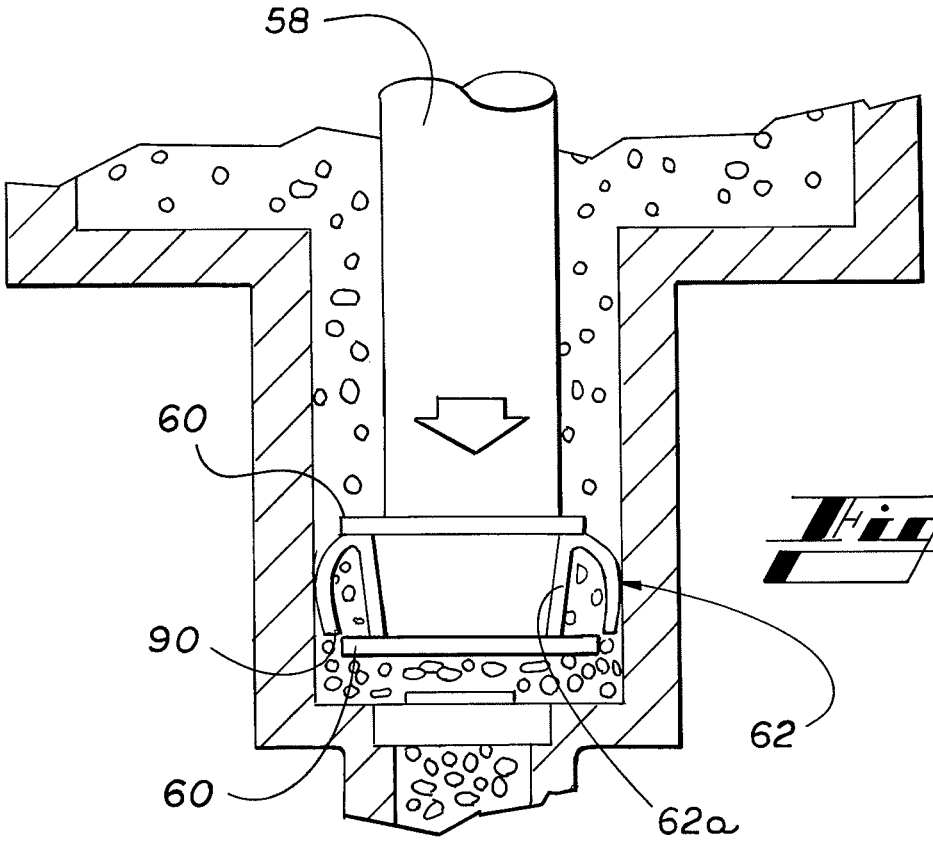
FIG. 12 is a cross sectional view of the shaft and gasket inside of the reservoir of an embodiment of the present invention, showing the gasket and shaft in an actively engaged or pumping position.

FIGS. 10-12 are cross sectional views of an embodiment of a shaft and gasket inside of a reservoir in accordance with the present invention. FIG. 10 shows the gasket and shaft in an actively disengaged or returned position, wherein the flanged edges of the annular flanged gasket engage the housing of the reservoir. FIG. 11 shows the gasket and shaft in a returning position wherein at least portions of the flanged edges of the annular flanged gasket disengage from the housing of the reservoir so as to allow liquid aroma to flow from the upper reservoir to the lower reservoir through the open check valve and then to the hose. FIG. 12 shows the gasket and shaft in an actively engaged or pumping position, wherein the flanged edges of the annular flanged gasket engage the housing of the lower chamber and the gasket forces controlled amounts of liquid aroma first into and then from the hose into the spa.

Figure 13:
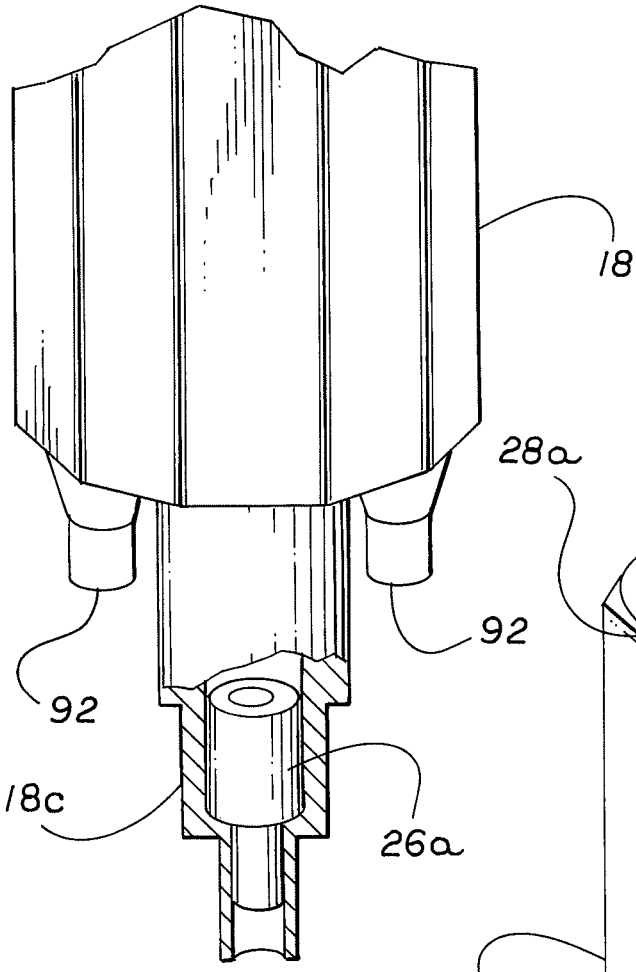
FIG. 13 is an enlarged partial cross-sectional view of a check valve inside of the reservoir of an embodiment of the present invention.
Figure 14:
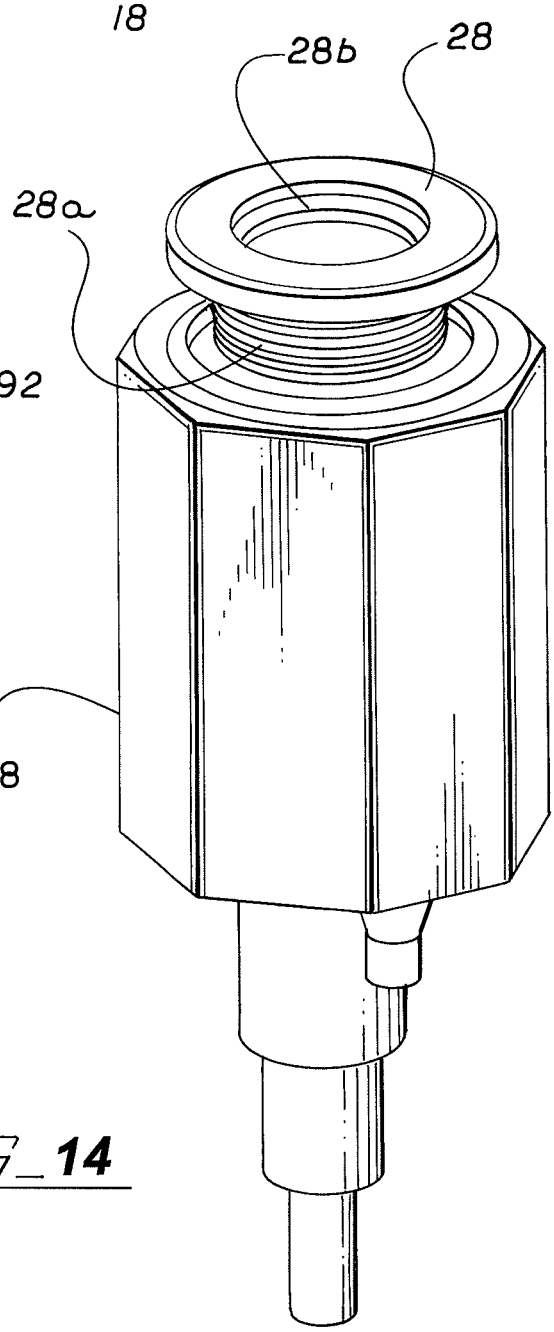
FIG. 14 is an elevation view of a wall fitting attached to the reservoir of an embodiment of the present invention.
Figure 15:
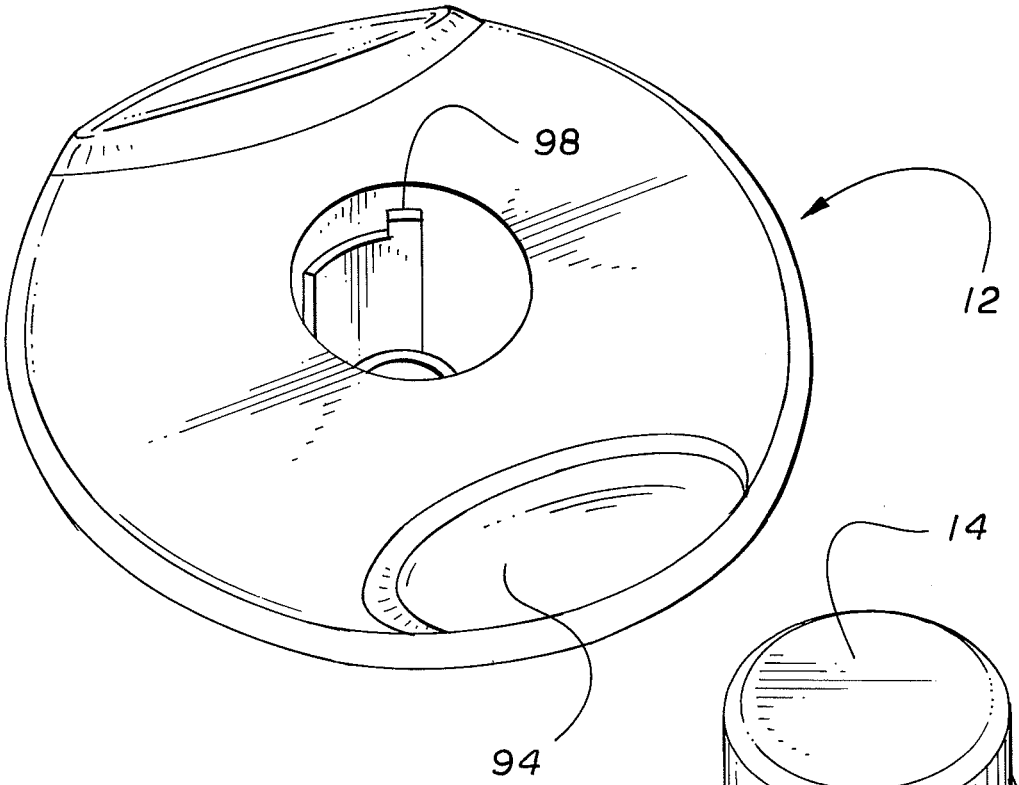
FIG. 15 is an elevation view of an alternative embodiment of a reservoir cap of the present invention, detailing a locking mechanism and a scalloped edge.
Figure 16:
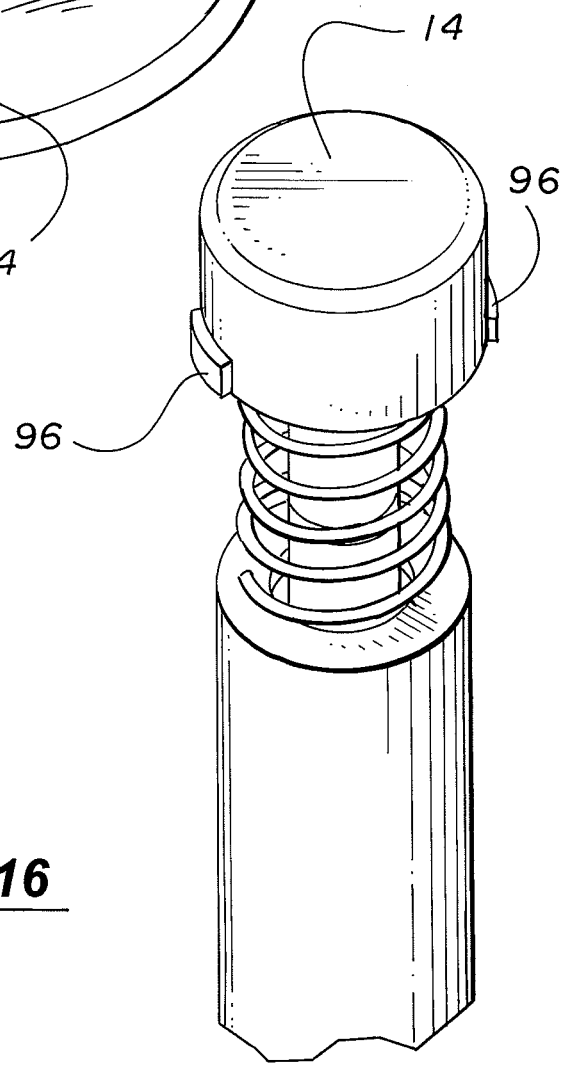
FIG. 16 is an elevation view of a portion of the shaft and plunger button removed from the reservoir cap, and further detailing the coiled spring and a locking mechanism of an embodiment of the present invention.

FIG. 13 shows a check valve inside of the reservoir, wherein the check valve allows the flow of liquid aroma from the reservoir into the hose, but prevents air or water from the hose or spa from entering the reservoir. FIG. 14 shows a wall fitting attached to the reservoir, removed from a spa shell. The wall fitting is capable of receiving and attaching the reservoir cap. FIG. 15 is an elevation view of an alternative embodiment of a reservoir cap of the present invention, detailing a locking mechanism and a scalloped edge. FIG. 16 is an elevation view of the shaft and plunger button removed from the reservoir cap, and further detailing the coiled spring and a locking mechanism of an embodiment of the present invention.

FIG. 1 illustrates the reservoir cap 12 of the liquid aroma injector assembly 10 and plunger button 14 and liquid aroma diffuser 30 installed in a typical hydrotherapy spa 20 by a wall fitting 28 (FIG. 6). Reservoir cap 12 is shown mounted on the shell 22 of the spa 20. FIG. 1 further illustrates the liquid aroma diffuser 30 mounted on the shell 22 of the spa 20 in the area of the spa 20 that would receive water 42 when in use. The plunger button 14 is shown in a disengaged position, elevated from the surface of the reservoir cap 12. An illustrative spa 20 may comprise multiple liquid aroma diffusers 30 each sharing the same reservoir 16.

FIG. 2 illustrates the liquid aroma injector assembly 10, removed from its mount in the spa 20, comprising a reservoir 16, a hose 32, and a liquid aroma diffuser 30. A reservoir 16 comprises a plunger assembly 50 (FIG. 3) including a reservoir cap 12 and a plunger button 14, a reservoir housing 18, and a nozzle fitting 34. The reservoir housing 18 is divided into a larger upper chamber 18*a* adjacent the top of the reservoir 16 in which the liquid aroma 40 can be stored, a smaller lower chamber 18*b* adjacent the bottom of the reservoir 16, and a subchamber 18*c* where a metered amount of liquid aroma 40 awaits dispensing by a user. The reservoir cap 12 is circular and, in a preferred embodiment, rounded with a hole disposed therein. The threaded neck 24 (FIG. 6) can be flanged and disposed upon the reservoir housing 18 or can be disposed upon a wall fitting 28 to accommodate easy mounting within a hole in the shell 22 of the spa 20, or within another suitable receptacle including within a wall adjacent a spa 20, a tub skirt, tile, decking, or a floor, for example. The threaded neck 24 can also releasably attach to a reservoir cap 12 having reciprocal threads 54 disposed upon a collar 52 defining the hole within the reservoir cap 12.

Check valves 26*a* (FIGS. 6 and 13) and 26*b* (FIG. 2) at each end of the hose 32 prevent spa water from backing into the liquid aroma injector 10 through the hose 32. One check valve 26*a* is adjacent and fluidly connected to subchamber 18*c* just above barbed nozzle fitting 34, and another check valve 26*b* is adjacent and fluidly connected to the liquid aroma diffuser 30. Ideally, in use, the liquid aroma injector 10 should be primed after being installed for use in conjunction with a spa 20 containing water 42 and filled with liquid aroma 40 by engaging the disengaging the plunger button 14 several times. This rids the liquid aroma injector 10 of air and allows the liquid aroma 40 to fill the hose 32 from one end to another end so that the liquid aroma 40 can be delivered in pre-determined amounts with each depression of the plunger button 14.

In preventing water 42 from the spa 20 from entering into the liquid aroma injector 10, the check valves 26*a* and 26*b* allow more precisely calibrated amounts and concentrations of liquid aroma 40 to be dispensed into the spa water 42 with each stroke of the plunger button 14. Further, because of differences in the viscosity of the spa water 42 and a typical liquid aroma 40 used in conjunction with a liquid aroma injector 10 in accordance with the present invention, a water-free hose 32 allows for the dispensation of clearly visible aliquot quantities of liquid aroma 40 into the spa water 42. Such visibility provides assurance to a user that the liquid aroma injector 10 is properly functioning.

A hollow, barbed nozzle fitting 34 extends from the subchamber 18*c* at the bottom of the reservoir 16 to receive the flexible tubing of the hose 32. A hole disposed within the nozzle fitting 34 forms a continuous, fluidly connected path extending through the subchamber 18*c*, the lower chamber 18*b*, and the upper chamber 18*a*, allowing liquid to flow within the reservoir 16 from the upper chamber 18*a*, through the lower chamber 18*b*, and out of the reservoir 16 through the nozzle fitting 34. The nozzle fitting 34 allows for both the sealed joining of the reservoir 16 to the proximal end (nearest to the reservoir 16) of the hose 32 and the flow of liquid aroma 40 past check valve 26*a*, into hose 32, past check valve 26*b*, and into the spa water 42 through the liquid aroma diffuser 30.

The distal end of the hose 32 is connected by another nozzle fitting 34 to the liquid aroma diffuser 30. Preferably, the nozzle fitting 34 comprises a thread-to-barb hose nozzle fitting 34. The liquid aroma diffuser 30 comprises a diffuser body 44 with a diffuser face 46. The diffuser face 46 has a plurality of holes 48 therein to allow for disbursement of liquid aroma 40 from the hose 32. The holes 48 can assume any pattern, but preferably the placement and direction of the holes 48 will facilitate an even distribution of the liquid aroma 40 throughout the water 42 of the spa 20. The nozzle fittings 34 are preferably detachable from the hose 32 so as to allow a user to remove, clean, and replace the nozzle fittings 34 and the hose 32 as needed. The liquid aroma diffuser 30 further comprises a nozzle nut 44*a* attached to the nozzle fitting 34 capable of releasably securing the said diffuser face 46.

The reservoir 16 preferably is constructed through an injection molding process, but other conventional examples of construction include blow molding and rotational molding. A thermoplastic polymer is used in one embodiment of a reservoir 16. Ceramics, composites, metals, other polymers, and combinations thereof are also contemplated.

With reference to FIG. 3, a plunger assembly 50 is shown detached from the reservoir 16, and comprises a reservoir cap 12, a plunger button 14, a stop 56, a shaft 58, a pair of stabilizers 60, and an annular flanged gasket 62. The reservoir cap 12 further comprises a collar 52 having reciprocal threads 54 disposed thereon. The reciprocal threads 54 allow the reservoir cap 12 to be attached to a wall fitting 28, (FIG. 6) or alternatively, directly to the reservoir 16. The shaft 58 can be releasably attached to (via reservoir cap 12) and extend through the upper chamber 18*a* and lower chamber 18*b* of the reservoir housing 18. The shaft 58 preferably comprises a threaded end 80 (FIGS. 5 & 9) which extends through the collar 52 of the reservoir cap 12 at the top of the reservoir 16 for releasably attaching the plunger button 14, and a stabilizing end (see stabilizers 60) for releasably attaching the annular flanged gasket 62 such that it can move within the lower chamber 18*b* when the plunger button 14 is engaged. The plunger button 14 can be integrally formed with the shaft 58, and moves up and down in a corresponding manner within the collar 52 when the plunger button 14 is engaged or disengaged. Coiled spring 82 (FIG. 9) provides resistance to an engaged plunger button 14 and returns the plunger button 14 to a predetermined static position when disengaged. The stop 56 contacts a bottom portion of the collar 52, and prevents movement of the plunger button 14 and the shaft 58 beyond a predetermined static position when the plunger button 14 is disengaged by blocking movement of the shaft 58 through the narrower opening of the collar 52.

A pair of stabilizers 60 are provided at the end of shaft 58 distal to the plunger button 14 in order to releasably secure annular flanged gasket 62 in place such that the fit of the annular flanged gasket 62 is loose enough that it can be removed and replaced by a user, yet tight enough that liquid cannot pass freely and/or easily through a gap between the annular flanged gasket 62 and the shaft 58 when in a static position.

With regard to FIG. 4, an embodiment of a liquid aroma diffuser 30 is shown in detail. The liquid aroma diffuser 30 comprises a diffuser body 44 releasably connected to a diffuser face 46 with a plurality of holes 48 by a nozzle nut 44*a*, said plurality of holes 48 preferably arranged in a pattern to promote distribution of the liquid aroma 40 throughout the water 42 of a spa 20. The diffuser body 44 is connected to a nozzle fitting 34, which allows both the connection of the liquid aroma diffuser 30 to the hose 32, and the exit of liquid aroma 40 from the liquid aroma diffuser 30 and into the spa 20. In another illustrative embodiment of the present invention, a liquid aroma diffuser 30 is attached to the hose 32 and is mounted in a recessed hole in the spa shell 22 cavity.

As discussed in more detail herein, when plunger button 14 is depressed, liquid aroma 40 flows in a first direction by a positive pressure induced by the depression of plunger button 14 through liquid aroma diffuser 30 into the spa 20, where it mixes with water 42 already in the spa 20. When plunger button 14 is released, check valves 26*a* and 26*b* (FIGS. 2 & 6) keep spa water 42 from backing into the hose 32. The release of plunger button 14 and the subsequent movement of shaft 58 and annular flanged gasket 62 allow liquid aroma 40 to flow around and past annular flanged gasket 62 from upper chamber 18*a* to lower chamber 18*b* where it can mix with water 42 from the spa 20 after it is injected by the next depression of the plunger button 14.

With regard to FIG. 5, an enlarged cross section of the shaft 58 of a partial plunger assembly 50 shows the pair of stabilizers 60 which position the annular flanged gasket 62 at the end of the shaft 58. The stabilizers 60 also grip the annular flanged gasket 62 when the shaft 58 moves in response to engagement and disengagement (depress and release, respectively) of the plunger button 14 and allow the annular flanged gasket 62 also to be removed from the shaft 58.

With regard to FIG. 6, a cross section of the reservoir 16 and the wall fitting 28 shows a threaded neck 24 of the reservoir housing 18 connecting to reciprocal threads 28*a* of the wall fitting 28. The wall fitting 28 also has additional threads 28*b* to receive and connect the reservoir cap 12. The wall fitting 28 is mounted within a hole in the spa shell cavity or another suitable receptacle including within a wall adjacent a spa 20, a tub skirt, tile, decking, or a floor, for example. In turn, the wall fitting 28 mounts the reservoir 16 so that it is attached, by the wall fitting 28, to the spa shell 22 or another suitable receptacle. After the reservoir 16 is secured on one side of the spa shell 22 or other suitable receptacle by the wall fitting 28, the reservoir cap 12 then can also be secured to the wall fitting 28 on the other side of the spa shell 22 or other suitable receptacle so that each of the reservoir 16, the wall fitting 28, and the reservoir cap 12 are joined together, respectively.

This illustrative embodiment beneficially allows a user to both remove and replace the reservoir cap 12 so that the reservoir 16 can be refilled with liquid aroma 40 without loosening the wall fitting 28 or reservoir 16 from their mount within the spa shell 22. Therefore, a user does not have to remove the entire reservoir 16 and its component parts from the spa shell 22 in order to refill with liquid aroma 40, which makes the liquid aroma diffuser 10 less susceptible to malfunction and promotes ease of use.

The reservoir 16 is divided, in a preferred embodiment, into three parts: the upper chamber 18*a*, the lower chamber 18*b* and subchamber 18*c*. When the device according to the present invention is in use, the upper chamber 18*a* is filled with a desired amount of liquid aroma 40 so that small amounts of the liquid aroma 40 can be released in to the water 42 of the spa 20. The lower chamber 18*b* houses a portion of the shaft 58 and a metered amount of liquid aroma 40 awaiting injection into the water 42 of the spa 20. Additionally, the shaft 58 and the annular flanged gasket 62 operate within the lower chamber 18*b*. The lower chamber 18*b* abuts the sides of the annular flanged gasket 62 such that when the shaft 58 and annular flanged gasket 62 move within the lower chamber 18*b*, liquid aroma 40 is expelled from the lower chamber 18*b* as described more fully below. Additionally, check valve 26*a* mounted in subchamber 18*c* keeps water 42 from the spa 20 from backing into the hose 32 and reservoir 16 of the liquid aroma injector 10.

In order to maximize the performance of the annular flanged gasket 62, the plunger assembly 50 is ideally set to a specific static position. The static position is determined by the wall thickness of the spa shell 22 material. Further, the distance from the top of the wall fitting 28 to the bottom of the reservoir 16 will be determined by the wall thickness of the spa shell 22 material. In one embodiment, the bottom edge of the annular flanged gasket 62 is just below a transition between the upper chamber 18*a* and the lower chamber 18*b* when the plunger button 14 is disengaged and the plunger assembly 50 is in a static position. This static position is held by the stop 56. Also preferably, when the plunger button 14 is engaged, the bottom or distal end of the shaft 58 extends completely to the bottom or distal end (adjacent the nozzle fitting 34) of the lower chamber 18*b*. This construction provides maximum suction and liquid aroma 40 release capabilities of an exemplary liquid aroma injector 10 in accordance with the present invention. Check valves 26*a* and 26*b* can be any suitable diaphragm, ball, swing, stop-check or other type of check valve. For example, a NEOPERL® check valve can be used in conjunction with the present invention.

With regard to FIG. 7, a shaft 58 and plunger button 14 are illustrated with the reservoir cap 12 removed. The plunger button 14 has a width greater than that of the shaft 58. In an exemplary embodiment, stop 56 has a diameter greater than that of the shaft 58 and less than that of the plunger button 14. A pair of stabilizers 60 having a diameter less than that of the plunger button 14 and greater than that of the shaft 58 are at the end of the shaft 58 distal to the plunger button 14 in order to secure an annular flanged gasket 62.

With regard to FIG. 8, a sectional view of the plunger assembly 50 is shown. A threaded end 80 of shaft 58 releasably attaches plunger button 14 to plunger assembly 50. Plunger button flanges 14*a* abut coiled spring 82 in order to provide resistance against plunger button 14 when engaged, and to return plunger button 14 to a static position when disengaged. Plunger button flanges 14*a* also prevent the plunger button 14 from moving into or through the threaded neck 24 of the reservoir housing 18. Stop 56 likewise prevents the plunger assembly 50 from dislodging from the reservoir housing 18 by providing an opposing force to the force provided by the coiled spring 82 when the plunger button 14 is disengaged. In other words, the stop 56 holds the shaft 58 in a static position once the stop 56 meets the collar 52 of the reservoir cap 12. The reservoir cap 12 is releasably joined with the wall fitting 28 or directly to the reservoir housing 18 when the reciprocal threads 54 of the collar 52 of the reservoir cap 12 are mated with the threaded neck 24 of the wall fitting 28 or the reservoir housing 18.

When the plunger button 14 is engaged, coiled spring 82 within the reservoir cap 12 contacts the plunger button 14 and is compressed and shaft 58 is moved downward in the same direction as the plunger button 14. The coiled spring 82 provides resistance upon engagement of the plunger button 14. Plunger button 14 and shaft 58 move within the collar 52 of the reservoir cap 12 and the threaded neck 24 of the reservoir housing 18. When plunger button 14 is disengaged, coiled spring 82 expands and presses against plunger button flanges 14*a*, which move plunger button 14 and shaft 58 (releasably attached by threaded end 80) in a direction opposite of an engaged plunger button 14. In assembly, plunger button 14 and collar 52 are fitted over shaft 58 at threaded end 80. Plunger button 14 is fitted over threaded end 80 through the reservoir cap 12 and screwed onto threaded end 80. Plunger assembly 50 then is releasably joined to the reservoir housing 18 by screwing together the reciprocal threads 54 on the collar 52 and the threaded neck 24. This mechanism for attachment and detachment allows a user to easily clean the liquid aroma injector 10 and facilitates refilling or emptying the reservoir 16.

Turning now to FIG. 9, the component parts of an exemplary embodiment of the present invention are shown in relation to one another. Indicia 84 show the directions of travel of the plunger button 14 and the shaft 58 when the plunger button 14 is engaged and disengaged. Simultaneously, the annular flanged gasket 62 is moved up and down within the lower chamber 18*b* of the reservoir 16. When the plunger button 14 is engaged, shaft 58 moves annular flanged gasket 62 downward through the lower chamber 18*b* and toward the hollow nozzle fitting 34. During use, the coiled spring 82 maintains the static position of the plunger button 14 after the plunger button 14 is disengaged. When engaged, the coiled spring 82 provides resistance to a bather pressing on the plunger button 14, and again returns the plunger button 14 to its static, elevated position as pressure on the plunger button 14 is released. Though the coiled spring 82 is biased to move the plunger button 14 and shaft 58 continuously outward from the reservoir housing 18 and through the reservoir cap 12, the stop 56 prevents it from doing so. Liquid aroma 40 is transferred as the coiled spring 82 engages the plunger button 14 to an extended position. The motion of the shaft 58 and the annular flanged gasket 62 downward forces liquid aroma 40 out through subchamber 18*c* and nozzle fitting 34 and the hose 32.

Turning now to FIGS. 10-12, cross sectional views of the shaft 58 and annular flanged gasket 62 inside of the reservoir 16 of an embodiment of the present invention demonstrate the pumping mechanism of the reservoir 16 which releases a controlled amount of liquid aroma 40 into a spa 20. FIG. 10 shows the annular flanged gasket 62 and shaft 58 in a disengaged or returned position. FIG. 11 shows the annular flanged gasket 62 and shaft 58 in a returning position, that is, moving upward after pumping liquid aroma 40 through the hose 32. FIG. 12 shows the annular flanged gasket 62 and shaft 58 in an actively engaged position, pumping liquid aroma 42 into and through the hose 32.

Generally, the annular flanged gasket 62 comprises a first vertical, tubular wall 62*a* and a second tubular, generally concave flanged ring 62*b* comprising flanged edges 90, said flanged ring 62*b* preferably having a V-shaped or partial D-shaped cross-section extending from a common vertex 62*c* and forming an angle 62*d*. In an exemplary embodiment, the approximate angle formed at the vertex 62*c* of the tubular wall 62*a* and the flanged ring 62*b* of the annular flanged gasket 62 is between 0 and 90 degrees. In a static position, such as shown in FIG. 10, the annular flanged gasket 62, specifically tubular wall 62*a*, is held in place on the shaft 58 by stabilizers 60 and, specifically flanged ring 62*b*, abuts the reservoir housing 18 of the lower chamber 18*b* and prevents more than a de minimis amount of release of liquid aroma 40 from upper chamber 18*a* to lower chamber 18*b* or subchamber 18*c*.

Referring to FIG. 10, the plunger assembly 50 is shown in the disengaged or resting position at the topmost of the pumping stroke. In this position, the flanged edges 90 of the annular flanged gasket 62 engage the reservoir housing 18 of the lower chamber 18*b*. In this position, the liquid aroma 40 is maintained within the upper chamber 18*a*.

Referring to FIG. 11, the plunger assembly is shown moving upward in a return stroke after having been depressed and having pumped liquid aroma 42 into the hose 32. As the shaft 58 moves upward, the flanged ring 62*b* of the annular flanged gasket 62 deforms and is forced downward and away from the reservoir housing 18 of the lower chamber 18*b*, allowing some liquid aroma 40 to be released in a controlled manner into the lower chamber 18*b*. The flanged ring 62*b* is forced inward toward the tubular wall 62*a* by a combination of the upward motion of the shaft 58 and a negative pressure created in the lower chamber 18*b* by the check valve 26*a* as the shaft 58 moves upward. Specifically, as the shaft 58 moves upward and the check valve 26*a* is closed, a negative pressure is created in the lower chamber 18*b*. This negative pressure within the lower chamber 18*b* causes liquid aroma 40 to deform the flanged ring 62*b* inward toward tubular wall 62*a*, which allows liquid aroma 40 to pass from upper chamber 18*a* into lower chamber 18*b*. In other words, when the shaft 58 rises, the annular flanged gasket 62 deforms inwardly enough for more liquid aroma 40 to flow into the lower chamber 18*b* in preparation for the next pump action (FIG. 12).

Referring now to FIG. 12, the plunger assembly 50 is shown in the engaged or pumping position in which the liquid aroma 40 in the lower chamber 18*b* is pumped out through the hose 32 by the annular flanged gasket 62. The pumping action of the plunger assembly 50 is activated when plunger button 14 is depressed, and shaft 58 moves downward. The bottom of the shaft 58 and annular flanged gasket 62, specifically flanged ring 62*b*, creates a positive pressure on the liquid aroma 40 in the lower chamber 18*b*, forcing the liquid aroma 40 through the open check valve 26*a* and into the hose 32. The liquid aroma 40 is introduced directly into the hose 32 through the check valve 26*a* when the flanged edges 90 of the annular flanged gasket 62 press tightly against the reservoir housing 18 of the lower chamber 18*b* by the downward action of the plunger assembly 50. The tight-fitting flanged edges 90 force the liquid aroma 40 through the check valve 26*a* and into the hose 32, then through check valve 26*b* and out into a spa 20 through the liquid aroma diffuser 30.

As can be seen, the upward movement of the plunger assembly 50 has the effect of allowing a certain amount of liquid aroma 40 to enter lower chamber 18*b* and subchamber 18*c* at a time (stroke), and the downward movement of the plunger assembly 50 has the effect of injecting the liquid aroma 40 into the spa 20. Concurrently, the action of pressing the plunger button 14 therefore has the effect of injecting a quantity of liquid aroma 40 into the spa 20.

FIG. 13 shows an alternative embodiment of the liquid aroma injector 10 having an angled prism shape. In one embodiment, the reservoir housing of the liquid aroma injector is an octagonal prism. This shape is beneficial to the installation of the liquid aroma injector 10, and facilitates ease of installation with various installation tools. Check valve 26*a* is shown inside of the subchamber 18*c*, wherein the check valve 26*a* allows the flow of liquid aroma 40 from the lower chamber 18*b* into the hose 32, but prevents air or water 42 in the hose 32 or spa 20 from entering the reservoir 16. In one alternative embodiment, LEDs are attached to the reservoir housing 18 by molded LED receptors 92. In this exemplary embodiment, the liquid aroma injector 10 can have clear components, such as the reservoir housing 18, the reservoir cap 12, and the plunger button 14 so that desired portions of the liquid aroma injector 10 may be lighted.

FIG. 14 details an exemplary embodiment of a wall fitting 28 attached to the reservoir housing 18, removed from a spa shell 22 or other suitable receptacle. The wall fitting 28 is capable of receiving and attaching the reservoir cap 12. In this exemplary embodiment, threads disposed upon the threaded neck 24 of the reservoir housing 18 mate with reciprocal threads 28*a* (FIG. 6) on the wall fitting 28 to attach the reservoir housing 18 to the wall fitting 28. In turn, additional threads 28*b* may be disposed upon the wall fitting 28 in order to further mate with reciprocal threads 54 disposed upon the reservoir cap 12. Thus, the reservoir cap 12 is joined to the wall fitting 28, which is joined to the reservoir housing 18.

FIGS. 15 and 16 are alternative embodiments of a reservoir cap 12 and plunger button 14 of the present invention, detailing a locking mechanism and scalloped edges 94. The plunger button 14 can have a twist-lock feature to keep from being pushed when disbursement of liquid aroma 40 is not wanted. This locking feature also prevents unintended releases of liquid aroma 40 into the spa 20. In an exemplary embodiment, the plunger button 14 comprises a locking mechanism with one or more locking tabs such as one or more flexible or pivotable locking finger tabs with cam shaped projections that is/are provided in the reservoir housing 18 and one or more receiving regions in the opposing surface of the shaft 58. For example, a plurality of locking tabs in the form of spring-like finger tabs with sloped surface projections that are each formed in at least one either the reservoir housing 18 or the shaft 58 while the other of either the reservoir housing 18 or the shaft 58 has a reception cavity formed in it to receive each finger tab that rides into and out of that reception cavity between lock and release states.

An example of a locking mechanism as shown in FIGS. 15 and 16 comprises a plunger button 14 and two spaced-apart tabs 96. Reservoir cap 12 has one or more reciprocal spaced-apart shoulders 98, which tabs 96 and corresponding shoulders 98 are rotated to be approximately 90 degrees apart when in an assembled and unlocked position. When a user rotates the plunger button 90 degrees such that the tabs 96 meet one or more corresponding shoulders 98 inside of the reservoir cap 12, the plunger button 14 cannot engage because the tabs 96 are blocked by the one or more shoulders 98.

The reservoir cap 12 can be formed in various suitable shapes, and, in an exemplary embodiment, can have scalloped edges 94 disposed thereon to serve as "grips." The scalloped edges 94 can be integrally molded into the reservoir cap 12 to aid in ease of removal of the reservoir cap 12. Alternatively, scalloped edges 94 can be formed by adhering raised portions to a molded reservoir cap 12.

With the present invention, separate spa blower systems are not needed in conjunction with the liquid aroma injector 10. The liquid aroma diffuser 30 can be structured to fit into a standard air control hole, which is a benefit for spa 20 manufacturers and consumers wishing to retrofit their existing spas. The reservoir 16 of an exemplary embodiment of the present invention is mounted within a shell 22 of a spa 20 above a maximum water 42 line, and said liquid aroma diffuser 30 is mounted within a shell 22 of a spa 20 below a maximum water 42 line.

The above detailed description of the embodiments, and the examples, are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. A liquid aroma injector for a spa, comprising:

a reservoir having a top and a bottom, and comprising an upper chamber proximal to the top of said reservoir, a subchamber proximal to the bottom of said reservoir, and a lower chamber located between said upper chamber and said chamber, said upper and lower chambers and said subchamber being in fluid communication with each other, wherein said lower chamber and said subchamber contain a metered amount of liquid aroma;

a plunger assembly capable of moving within said reservoir and comprising a plunger button for moving the plunger assembly, an annular flanged gasket, and a shaft connecting the plunger button and the annular flanged gasket, wherein said annular flanged gasket comprises a vertical, tubular wall and a tubular flanged ring, together having a V-shaped or partial D-shaped cross section extending from a common vertex with a tubular wall at an angle;

a hollow nozzle fitting attached to the bottom of said reservoir and having a channel therethrough, whereby liquid aroma can flow within the reservoir from said upper chamber, through said lower chamber, through said subchamber, and out of the reservoir through the hollow nozzle fitting;

a hose connected to said hollow nozzle fitting at a first end and in fluid connection with the reservoir, whereby the liquid aroma can flow through a hollow nozzle channel within said hollow nozzle fitting into the hose; and a liquid aroma diffuser connected to said hose at a second end and in fluid communication with the hose, whereby, when said plunger button is depressed, the tubular flanged ring of the annular flanged gasket moves within said lower chamber and said plunger assembly injects only the metered amount of the liquid aroma into water in the spa.

2. The apparatus of claim 1, further comprising a coiled spring within a reservoir cap for contacting said plunger button and providing resistance upon engagement of said plunger button.

3. The apparatus of claim 2, wherein said reservoir is mounted within wall fitting within a shell of the spa above a maximum water line, and said liquid aroma diffuser is mounted within the shell of the spa below the maximum water line.

4. The apparatus of claim 3, wherein a stop contacts a bottom portion of a collar when the plunger button is disengaged, and whereby a stop prevents said shaft from moving past a static position from the reservoir cap and the collar.

5. A liquid aroma injector for a spa, comprising:

a reservoir containing liquid aroma, the reservoir comprising a reservoir housing defining an upper chamber, a lower chamber, and a subchamber containing a metered amount of the liquid aroma, wherein the upper chamber is in fluid connection with the lower chamber;

a plunger assembly comprising a plunger button connected to a first end of a shaft;

an annular flanged gasket attached to a second end of the shaft, wherein said annular flanged gasket comprises a tubular wall, and a tubular flanged ring attached to said tubular wall at a first end to form a vertex, and wherein the tubular flanged ring of the annular flanged gasket contacts the reservoir housing of the lower chamber at a flanged edge;

a hose in fluid connection with said reservoir, wherein liquid aroma flows from the reservoir past the tubular flanged ring of the annular flanged gasket, into the hose at a first end, and expelled from the hose at a second end when the plunger button is engaged; and a liquid aroma diffuser releasably attached to the hose at said second end, wherein said reservoir is mounted within a wall fitting within a shell of the spa above a maximum water line, and said liquid aroma diffuser is mounted within the shell of the spa below the maximum water line, whereby, when said plunger button is depressed, said plunger assembly injects only the metered amount of the liquid aroma into the water in the spa.

6. The apparatus of claim 5, wherein the vertex formed by an intersection of said tubular wall and said tubular flanged ring is between 10 and 90 degrees.

7. The apparatus of claim 5, wherein the vertex formed by an intersection of said tubular wall and said tubular flanged ring is between 30 and 45 degrees.

8. A liquid aroma injector for a spa, comprising:

a reservoir, wherein said reservoir comprises a reservoir housing defining an upper chamber, a lower chamber below said upper chamber, and a subchamber below said lower chamber, the upper chamber, the lower chamber, and the subchamber being in fluid connection with each other, and a threaded neck;

a plunger assembly, wherein said plunger assembly comprises:

a reservoir cap having a collar with threads disposed thereon which couple with said threaded neck to releasably connect the plunger assembly to the reservoir;

a plunger button mounted within the collar of the reservoir cap;

a shaft releasably connected to said plunger button and extending through both the upper and lower chamber; and an annular flanged gasket releasably connected to said shaft, wherein the annular flanged gasket further comprises a tubular wall and a tubular flanged ring attached to a first ring at a first end to form a vertex, wherein the annular flanged gasket moves within said lower chamber upon engagement of said plunger button;

a first nozzle fitting releasably connected to the reservoir housing adjacent the lower chamber;

a hose releasably connected at a first end to said first nozzle fitting;

a second nozzle fitting releasably connected to a second end of said hose;

a liquid aroma diffuser releasably connected to said second nozzle fitting;

light-emitting diodes affixed to the reservoir housing by molded LED receptors; and at least one visually clear component that is lighted upon engagement of the light-emitting diodes, wherein the at least one visually clear component is selected from the group consisting of the reservoir housing and the reservoir cap, wherein the lower chamber and the subchamber contain a metered amount of liquid aroma, whereby, when said plunger button is depressed, said plunger assembly injects only the metered amount of the liquid aroma into water in the spa.

9. The apparatus of claim 8, wherein the second nozzle fitting comprises a thread-to-barb hose nozzle fitting, and wherein said liquid aroma diffuser further comprises a diffuser face with a plurality of holes disposed therein, and a nozzle nut capable of releasably securing said diffuser face.

10. The apparatus of claim 8, wherein said reservoir is mounted within a wall fitting within a shell of the spa above a maximum water line, and said liquid aroma diffuser is mounted within the shell of the spa below the maximum water line.

11. The apparatus of claim 8, further comprising a coiled spring within said threaded neck of said reservoir cap for contacting said plunger button and providing resistance upon engagement of said plunger button.

12. The apparatus of claim 8, wherein said plunger button further comprises two spaced-apart tabs, and said reservoir cap further comprises reciprocal spaced-apart shoulders, wherein said tabs and said corresponding shoulders meet inside of the reservoir cap and wherein said plunger button is blocked prevented from engaging by the shoulders when the plunger button is twisted.

13. The apparatus of claim 8, wherein said reservoir cap comprises one or more scalloped edges.

14. The apparatus of claim 8, wherein the tubular flanged ring of the annular flanged gasket contacts the reservoir housing of the lower chamber at a flanged edge.

* * * * *